United States Patent [19]

Henderson et al.

[11] Patent Number: 4,969,516

[45] **Date of Patent: * Nov. 13, 1990**

[54] PACKOFF RUNNING TOOL WITH ROTATIONAL CAM

[75] Inventors: H. O. Henderson; Fergus C. Hines; Lionel J. Milberger, all of Houston, Tex.

[73] Assignee: Vetco Gray Inc., Houston, Tex.

[ * ] Notice: The portion of the term of this patent subsequent to Aug. 21, 2007 has been disclaimed.

[21] Appl. No.: 362,843

[22] Filed: Jun. 6, 1989

Related U.S. Application Data

[63] Continuation-in-part of Ser. No. 286,603, Dec. 16, 1988.

[51] Int. Cl.[5] ..... F21B 23/06

[52] U.S. Cl. ..... 166/182; 166/208; 166/368; 166/387

[58] Field of Search ..... 166/82, 86, 88, 182, 166/208, 212, 217, 348, 358, 368, 381, 382, 383, 387; 285/18, 133.2, 140, 141

[56] References Cited

U.S. PATENT DOCUMENTS

| | | | |
|---|---|---|---|
| 3,897,823 | 8/1975 | Ahlstone | 166/120 |
| 3,933,202 | 1/1976 | Ahlstone | 166/182 |
| 4,674,576 | 6/1987 | Goris et al. | 166/125 |
| 4,712,621 | 12/1987 | Wightman et al. | 166/382 |
| 4,736,799 | 4/1988 | Ahlstone | 166/182 |
| 4,757,860 | 7/1988 | Reimert | 166/208 |
| 4,811,784 | 3/1989 | Theiss | 166/208 |
| 4,823,871 | 4/1989 | McEver et al. | 166/182 |

*Primary Examiner*—Stephen J. Novosad
*Assistant Examiner*—Terry Lee Melius
*Attorney, Agent, or Firm*—James E. Bradley

[57] ABSTRACT

A running tool for setting a casing hanger packoff in a subsea well has a connection assembly that connects the running tool to the casing hanger. The running tool has a mandrel which connects to a string of drill pipe. A setting sleeve is carried by the mandrel for carrying the packoff. The mandrel carries a body also. The body has a split ring which moves between an extended position engaging a groove located in the casing hanger to a retracted position. The split ring moves between the engaged and retracted positions by longitudinal movement of an annular cam. The cam is threaded to the body, and when rotated, will move longitudinally. The mandrel extends through the cam and has a longitudinal slot. A dog engages the slot in the mandrel. A flexible link connects the dog to the cam so that rotation of the mandrel rotates the cam. The dog is biased by the flexible link to allow the slot to move downward below the dog when the mandrel moves to the packoff setting position.

4 Claims, 6 Drawing Sheets

DETAILED DESCRIPTION OF THE INVENTION

Referring to FIG. 1, running tool 11 has a stem or mandrel 13 that extends through it. Mandrel 13 is a tubular member and connects on its upper end to a string of drill pipe (not shown). Running tool 11 has a body, which is in two parts, upper body 15 and lower body 17. Mandrel 13 carries the upper body 15 and lower body 17.

The lower body 17 connects to a casing hanger 19. Casing hanger 19 secures to the upper end of a string of casing (not shown) which will be lowered into the well by the running tool 11. Casing hanger 19 will land on a wellhead (not shown) which normally will be a subsea wellhead located on the sea floor. Casing hanger 19 has an inner wall 21 that contains a circumferential groove 23.

Running tool 11 has an engaging element for engaging the groove 23. This engaging element comprises a split ring 25 and a plurality of link pins 27. The split ring 25 locates in a circumferential groove on the exterior of the lower body 17. The split ring 25 will move from a retracted non-engaging position, shown in FIG. 1*b*, to an engaging position as shown in FIG. 2*b*. The link pins 27 (only one shown) locate within radial passages extending through the wall of the lower body 17. The link pins 27 move radially inward and outward to push the split ring 25 to the engaged position, and to allow it to retract to the non-engaging position.

A cam 29 moves the link pins 27 inward and outward. Cam 29 is an annular member located within a cavity of the lower body 17. Mandrel 13 extends axially through the cam 29. Cam 29 has a lobe 31 on its exterior wall. Lobe 31 separates and protrudes outward from a lower recess 33 and an upper recess 35. When lobe 31 locates radially inward of the pins 27, it will push them outward, moving the split ring 25 to the engaged position. When the lower recess 33 contacts the link pins 27, the link pins will be retracted, as shown in FIG. 1*b*. Similarly, when the upper recess 35 engages the link pins 27, as shown in FIG. 6*b*, the split ring 25 will retract.

Cam 29 has a set of external threads 38 which engage a set of internal threads 37 in the lower body 17. Threads 37 in the preferred embodiment are located above the lobe 31. Rotating the cam 29 on the threads 37 relative to the lower body 17 causes the cam 29 to move longitudinally relative to lower body 17.

A rotational linking means cooperates with the cam 29 and mandrel 13 to cause rotation of the mandrel 13 to rotate the cam 29. The rotational linking means comprises a dog 39 which is adapted to engage a slot 41. The slot 41 is formed in the exterior of the mandrel 13 and has a selected axial length. When the mandrel 13 is in the uppermost position as shown in FIG. 1*b*, the dog 39 will be located near the base of the slot 41. When the mandrel 13 moves to its lowermost position shown in FIG. 4*b*, the slot 41 moves completely below the dog 39 and the lower body 17.

Dog 39 is able to move into and out of the slot 41 by means of a bias means which urges the dog 39 into engagement with the mandrel 13. The bias means comprises a flexible linking member 43. Linking member 43 has a lower end which connects to the cam 29 for movement therewith. The upper end is integrally joined to the dog 39. Linking member 43 is a thin, flexible member that is resilient. It cantilevers the dog 39 from the cam 29.

The setting features of the running tool 11 include a mandrel piston 45, which is shown in FIG. 1*a*. Mandrel piston 45 is an annular element formed on the exterior the mandrel 13 and received within a cylindrical bore inside the upper body 15. The upper body 15 carries an annular setting sleeve piston 47 within a setting sleeve chamber 49. Setting sleeve chamber 49 is hydraulically linked to the mandrel piston 45 by means of passages 51. As the mandrel piston 45 moves downward relative to the upper body 15, hydraulic fluid contained within the passages 51 will cause the setting sleeve piston 47 to move downward. The passages 51 are sealed from the exterior of the running tool 11 and filled with a hydraulic fluid while the running tool 11 is at the surface.

The upper body 15 supports a setting sleeve 53 by means of a pin 55. Setting sleeve 53 carries a packoff 57, as shown in FIG. 1*b*. Packoff 57 is preferably of a metal type. A ratchet member 59 connects the packoff 57 to the setting sleeve 53. The ratchet member 59 will release from the packoff 57 by an upward pull of sufficient magnitude after the packoff 57 has been set.

Referring to FIG. 3, when setting the packoff 57, it must first be moved down to a position located between the casing hanger 19 and wellhead (not shown). When this occurs, the upper body 15 will move downward relative to the lower body 17. Once the upper body 15 is in the lower position, it will be locked to the lower body 17 by a locking means so as to prevent any axial movement.

The locking means comprises a latch ring 61, shown in FIG. 1*b*. Latch ring 61 has grooves on its exterior which ratchet into and engage grooves 63 formed in an interior wall of the lower body 17. Latch ring 61 locates within a recess formed in the lower end of the upper body 15. A release member 65, incorporated with the latch ring 61, causes the latch ring 61 to retract when an upward force is applied to the release member 65.

Once the latch ring 61 registers with grooves 63, as shown in FIG. 3*b*, it will be maintained in that position by means of a split ring 67. Split ring 67 will push against a plurality of pins 69, which in turn provide a backup for the latch ring 61. While in the upper position shown in FIG. 1*b*, the split ring 67 will be located in a recess 71, allowing the latch ring 61 to retract. Recess 71 is an annular recess located on the exterior of the mandrel 13.

A set of mating threads 73 formed on the lower body 17 engage exterior threads 75 formed on the mandrel 13. Engagement of the threads 73, 75 supports the mandrel 13 in the upper position shown in FIG. 1*b*.

In operation, the casing hanger 19 will be secured to the upper end of a string of casing (not shown). The running tool 11 will be connected to the casing hanger 19 at the surface, as shown in FIG. 1*b*. Running tool 11 is lowered into the casing hanger 19 with the split ring 25 in a retracted position. The cam recess 33 will be engaging the link pins 27. The mandrel piston 45 will be located at the upper end of the upper body 15 to support the upper body 15, as shown in FIG. 1*a*. The dog 39 will be located at the lower end of the slot 41, as shown in FIG. 1*b*.

The mandrel 13 is then rotated four turns to the right. This drives the cam 29 downward to the position shown in FIG. 2*b*. In this position, lobe 31 engages link pins 27, pushing the split ring 25 outward into engagement with the groove 23. The running tool 11 will now be locked to the casing hanger 19.

PACKOFF RUNNING TOOL WITH ROTATIONAL CAM

CROSS-REFERENCE TO RELATED APPLICATION

This is a continuation-in-part of application Ser. No. 286,603, filed Dec. 16, 1988, CASING HANGER RUNNING TOOL USING STRING WEIGHT.

BACKGROUND OF THE INVENTION

1. Field of the Invention

This invention relates in general to tools for running casing hangers in subsea wells, and in particular to a tool that utilizes a cam actuated engaging element to connect the tool to a casing hanger.

2. Description of the Prior Art

A subsea well of the type concerned herein will have a wellhead supported on the subsea floor. One or more strings of casing will be lowered into the wellhead from the surface, each supported on a casing hanger. The casing hanger is a tubular member that is secured to the threaded upper end of the string of casing. The casing hanger lands on a landing shoulder in the wellhead, or on a previously installed casing hanger having larger diameter casing. Cement is pumped down the string of casing to flow back up the annulus around the string of casing. After the cement hardens, a packoff is positioned between the wellhead bore and an upper portion of the casing hanger. This seals the casing hanger annulus.

One type of packoff utilizes a metal seal so as to avoid deterioration with time that may occur with elastomeric seals. Metal seals require a much higher force to set than elastomeric seals. Prior art running tools have employed various means to apply the downward force needed to set a packoff. Some prior art tools use rotation of the drill string to apply setting torque. It is difficult to achieve sufficient torque to generate the necessary forces for a metal packoff, because the running tool may be located more than a thousand feet below the water surface in deep water.

Other running tools and techniques shown in the patented art apply pressure to the annulus surrounding the drill string on which the running tool is suspended. The amount of annulus pressure is limited, however, to the pressure rating of the riser through which the drill string extends. This pressure rating is normally not enough to set a metal packoff.

Higher pressure can be achieved by pumping through the drill string. However, this requires a running tool with some type of ports that are opened and closed from the surface. This is necessary because cement must first be pumped down the drill string. The ports may be open and closed by dropping a ball or dart. A considerable amount of time, however, is required for the ball to reach the seat. Rig time is quite expensive. Another method employs raising and lowering the drill pipe and rotating in various manners to engage and disengage J-slots to open and close ports. This has a disadvantage of the pins for the J-slots wearing and not engaging properly.

In application Ser. No. 286,603, filed Dec. 16, 1988, Lionel J. Milberger, et al, a running tool is proposed which uses differential pistons and drill string weight to set the packoff. In the tool shown in that application, a split ring connects the tool body to the casing hanger by locating within grooves in an inner wall of the casing hanger. A cam moves vertically within the body of the tool to push the split ring inward and outward between engaging and non-engaging positions. The cam moves axially by means of movement of a mandrel located within the tool.

While the connection of the tool to the casing hanger as shown in application Ser. No. 286,603 is workable, the cam has a position that it travels through during the setting procedure that is a non-engaging position. Concerns have been expressed about the tool being in a released position from the casing hanger prior to the packoff being fully set.

SUMMARY OF THE INVENTION

In this invention, an engaging element, preferably a split ring, connects the tool body to the casing hanger by engaging a groove located within an inner wall of the casing hanger. A cam moves the split ring between the inner and outer positions. The cam is secured by threads to the body so that rotation of the cam relative to the body will cause it to move longitudinally. The cam has a lobe which engages the split ring to push it to the engaging position. Rotating the cam relative to the body will also move the lobe out of alignment with the split ring to move the split ring to the non-engaging position.

The tool has a mandrel which connects to the drill string and extends through the tool for performing the setting function. The mandrel rotates the cam to move the lobe into engagement with the split ring. This is handled by a slot which is located on the exterior of the mandrel and a dog which is connected with the cam. The dog is adapted to enter the slot to lock the cam to the mandrel for rotation therewith.

A bias means urges the dog into the slot, and also allows the dog to move out of the slot when the mandrel moves downward. When the mandrel moves downward in a setting function, the slot will move below the dog and cam. After the setting has been performed, picking up the mandrel causes the slot to locate adjacent the dog. Rotating the mandrel causes the dog to enter the slot to rotate the cam. Rotating the cam causes the lobe to move out of engagement with the split ring to free the tool from the casing hanger.

The running tool 11 will then be lowered from the drilling vessel, through a riser (not shown) and down into the wellhead at the sea floor. The casing hanger 19 will land on a landing profile located in the wellhead. Cement will be pumped down the drill string. The cement flows through the casing and back up the annulus surrounding the casing. Returns from the cementing flow past vertical passages and channels formed in the casing hanger 19 and running tool 11 exteriors.

Figure 2A:
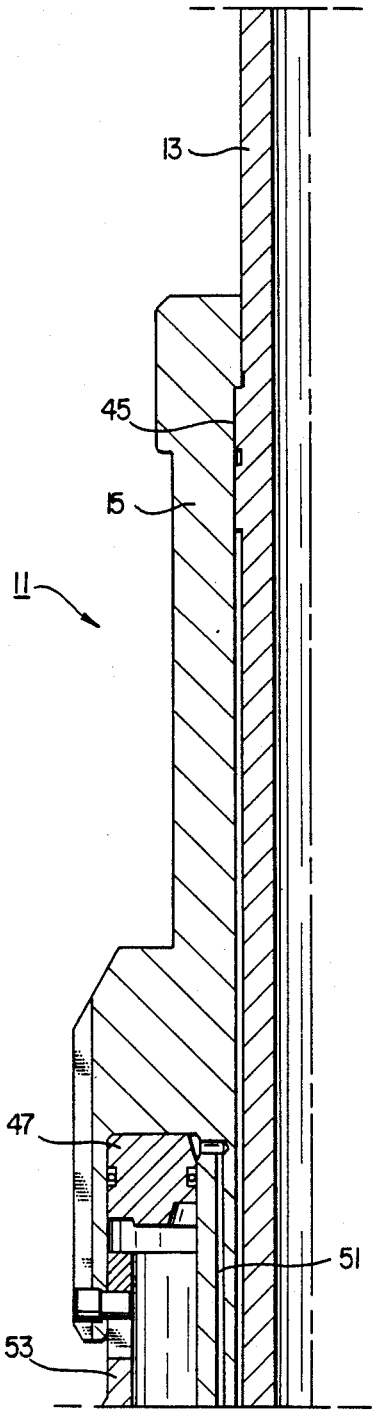
FIGS. 2*a* and 2*b* comprise a vertical sectional view of the running tool of FIG. 1, showing the running tool connected to a casing hanger.
Figure 2B:
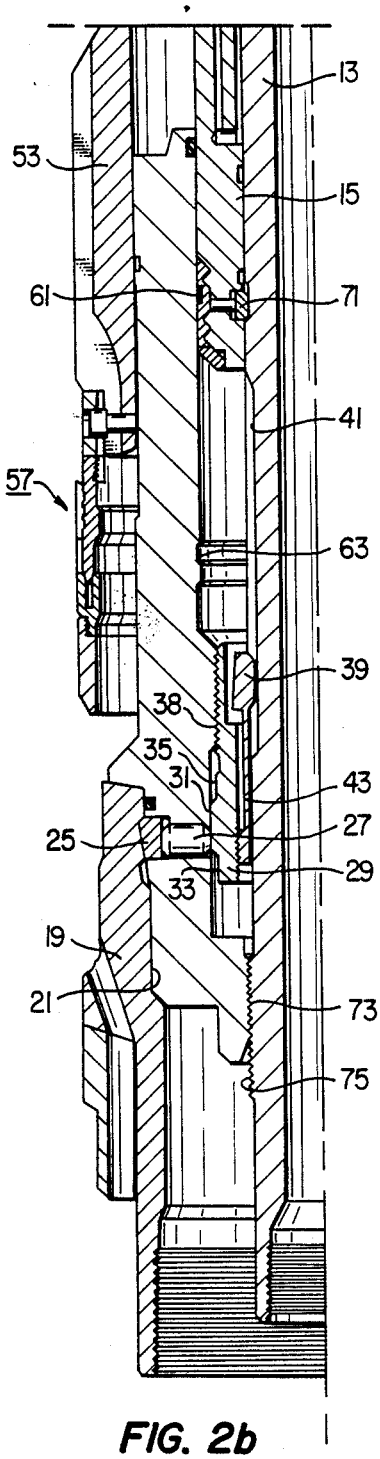

After the cement has set, the packoff 57 will be lowered into the annular space surrounding the casing hanger 19. This is handled by rotating the drill string four times to the right. As the mandrel 13 rotates, its threads 75 will unscrew from the threads 73 (FIG. 2*b*). The upper body 15 and mandrel 13 will drop approximately 12 inches to the position shown in FIG. 3*b*. In this position, the latch ring 61 will snap into the groove 63. This locks the upper body 15 and the lower body 17 axially together.

Figure 3A:
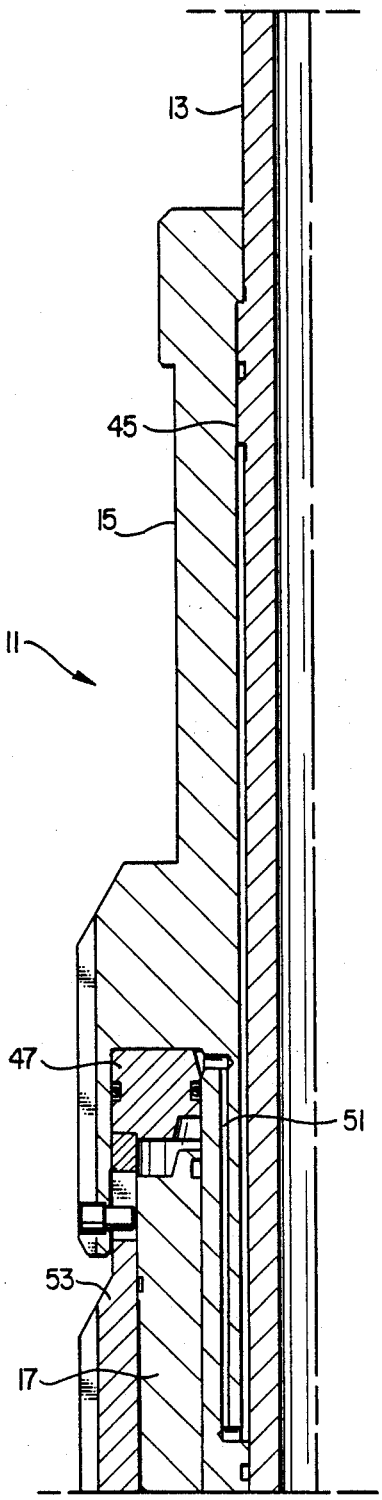
FIGS. 3*a* and 3*b* comprise a vertical sectional view of the running tool of FIG. 1, and showing the running tool in a position with the packoff lowered and ready to be set.
Figure 3B:
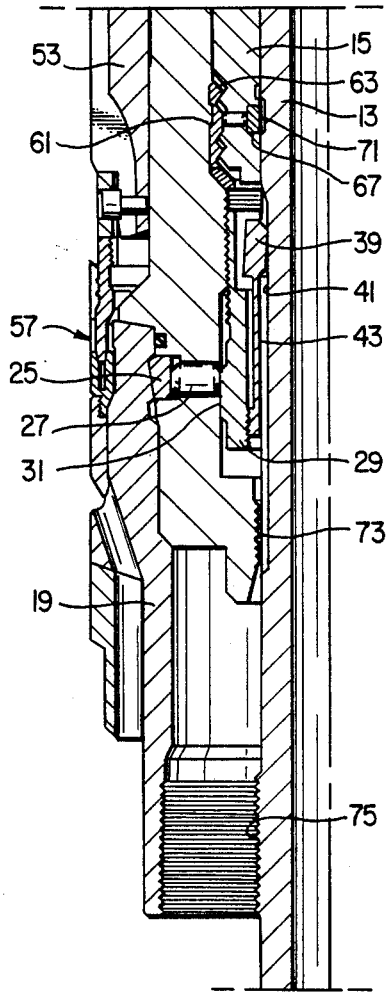

During the four turns of rotation from the position shown in FIG. 2*b* to the position shown in FIG. 3*b*, the cam 29 will move downward slightly. However, the lobe 31 will still be engagement with the link pins 27. The packoff 57 will move into the annular space surrounding the casing hanger 19.

Figure 4A:
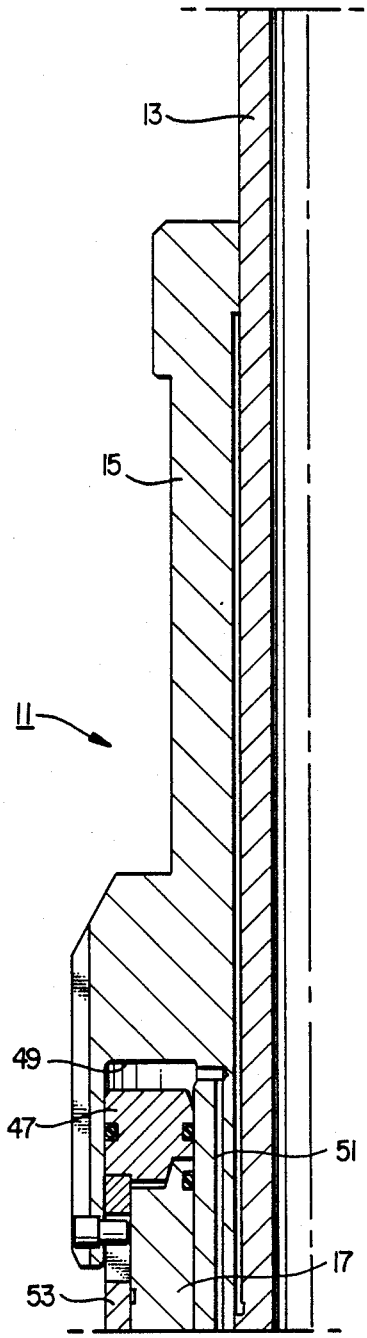
FIGS. 4*a* and 4*b* comprise a vertical sectional view of the running tool of FIG. 1, and showing the running tool in a position with the packoff set.
Figure 4B:
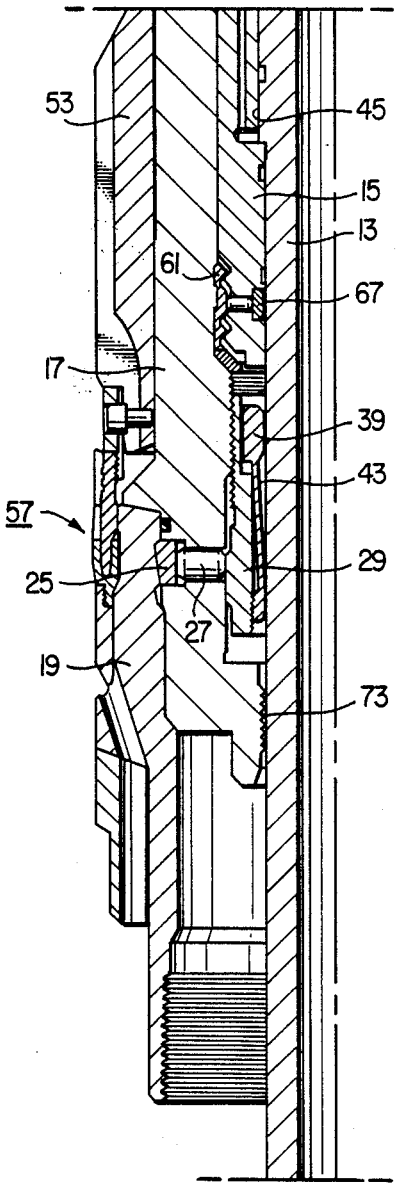

Continued downward movement of the mandrel 13 will move the mandrel to the fully stroked position shown in FIGS. 4*a* and 4*b*. The weight of the drill string above the running tool 11 assists in this downward movement. In this downward movement, the mandrel piston 45 moves downward relative to the upper body 15. The recess 71 moves downward relative to the ring 67. The slot 41 moves downward relative to the dog 39, passing below the dog 39. The cam 29 remains stationary.

The downward movement of mandrel 13 from the position in FIG. 3*b* to the position in FIG. 4*b* increases the pressure of the hydraulic fluid in the passages 51. Setting sleeve piston 47 presses against the top of the setting sleeve 53. This compressive force on the packoff 57 causes the packoff to set. The fully set position is shown in FIGS. 4*a* and 4*b*.

Figure 5A:
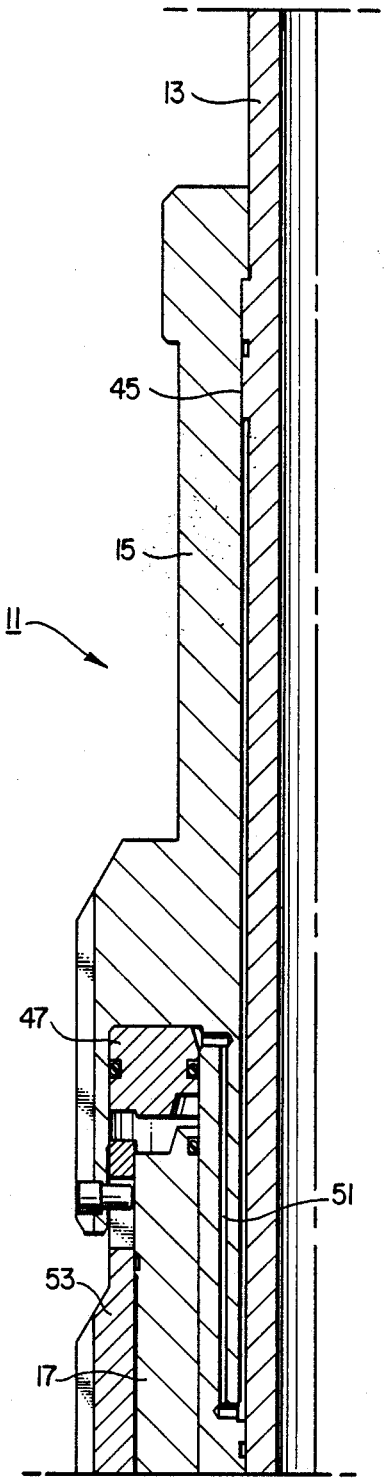
FIGS. 5*a* and 5*b* comprise a vertical sectional view of the running tool of FIG. 1, and showing the tool in the process of being released from the casing hanger.
Figure 5B:
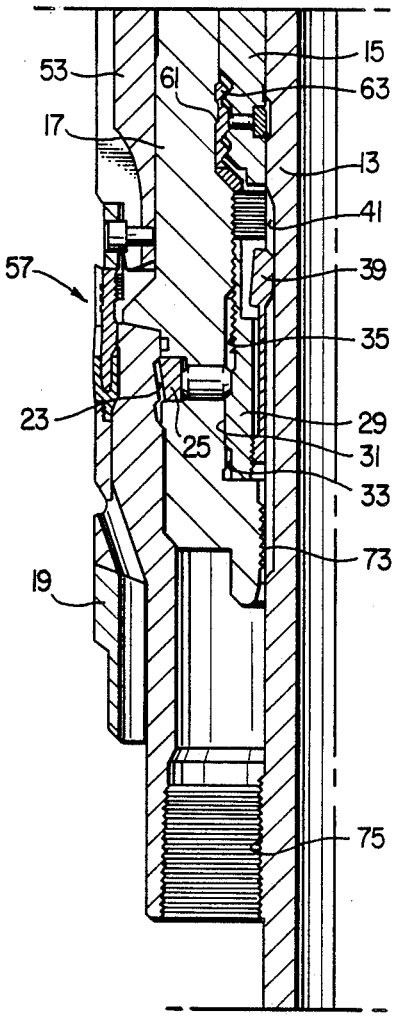

After testing, the running tool 11 will be released. First, the drill string is picked up to pull the mandrel 13 up as far as it will go. The mandrel piston 45 will contact the upper body 15. The slot 41 will move up into alignment with the dog 39. The drill string then is rotated four more times to the right. The dog 39 will enter the slot 41, causing the cam 29 to begin rotating in the threads 37 as the mandrel 13 is rotated. The cam 29 will move downward in the lower body 17 until the recess 35 engages the link pins 27. This allows the split ring 25 to retract to a non-engaging position. This is the position shown in FIG. 5*b*.

Figure 6A:
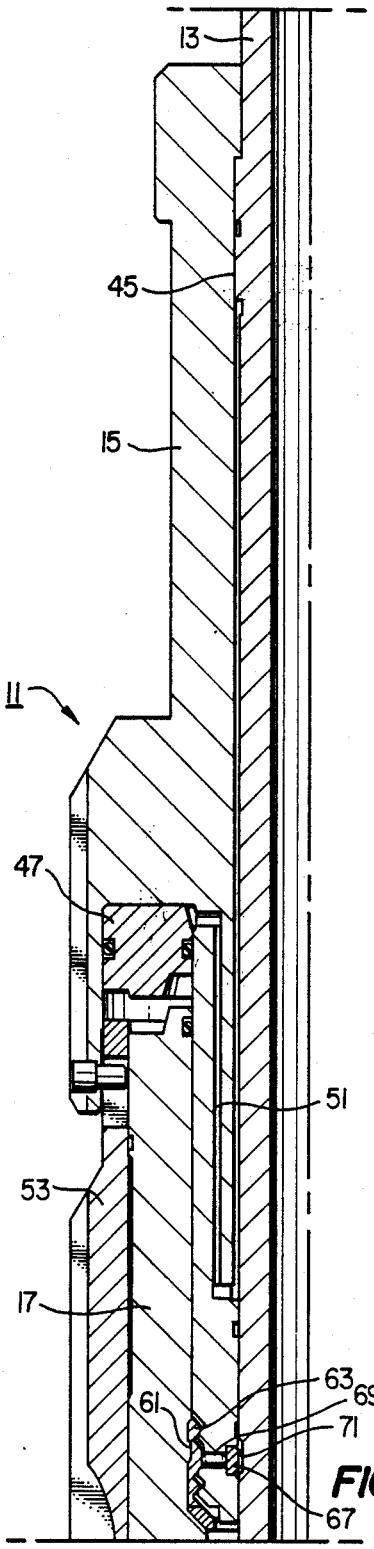
FIGS. 6*a* and 6*b* comprise a vertical sectional view of the running tool of FIG. 1, showing the running tool being pulled upward from the casing hanger.
Figure 6B:
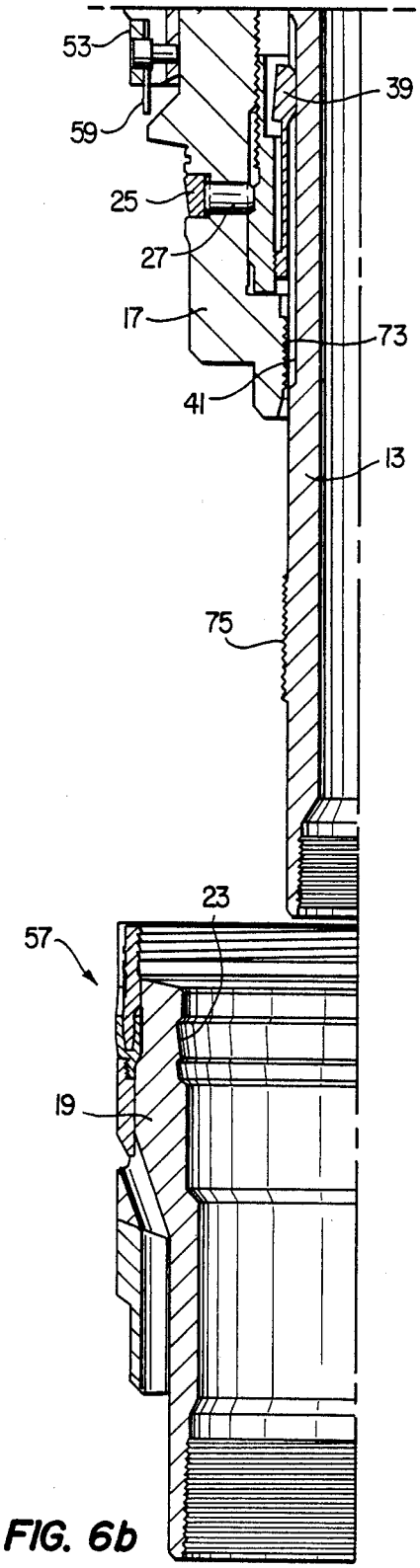

Then, the drill string is picked up. At about 5,000 pounds pull, the ratchet member 59 will pull loose from the packoff 57. Running tool 11 will be retrieved to the surface, as shown in FIGS. 6*a* and 6*b*.

To reuse the running tool 11 for setting another packoff, the running tool 11 must recocked at the surface. This is handled by rotating the mandrel 13 to the left relative to the upper and lower bodies 15, 17. This causes the cam 29 to move upward in the lower body 17 until it contacts the release member 65 of latch ring 61. This causes the latch ring 61 to collapse and disengage from the grooves 63.

Figure 1A:
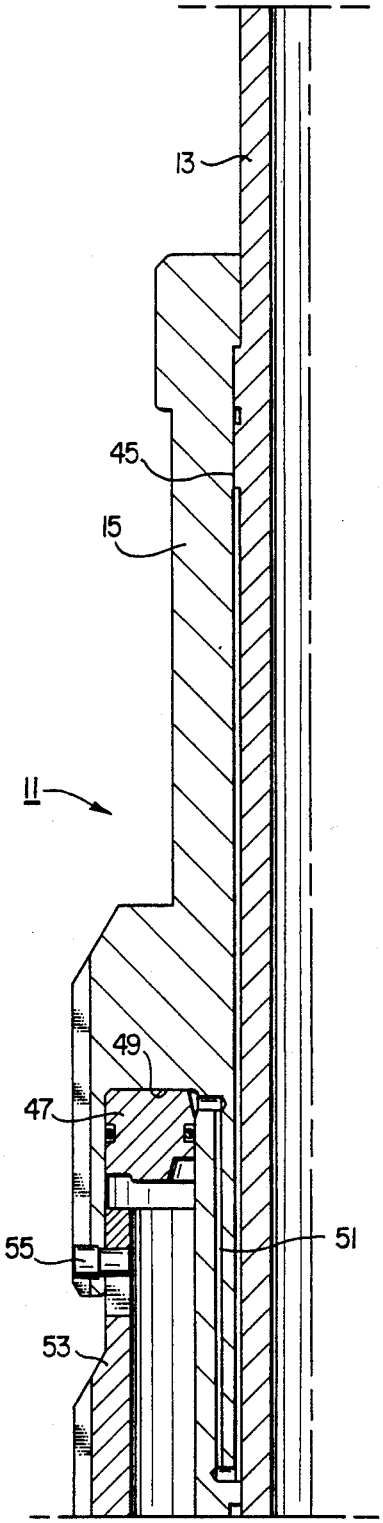
FIGS. 1*a* and 1*b* comprise a vertical sectional view illustrating a running tool constructed in accordance with this invention, and shown in a position prior to connecting the running tool to a casing hanger.
Figure 1B:
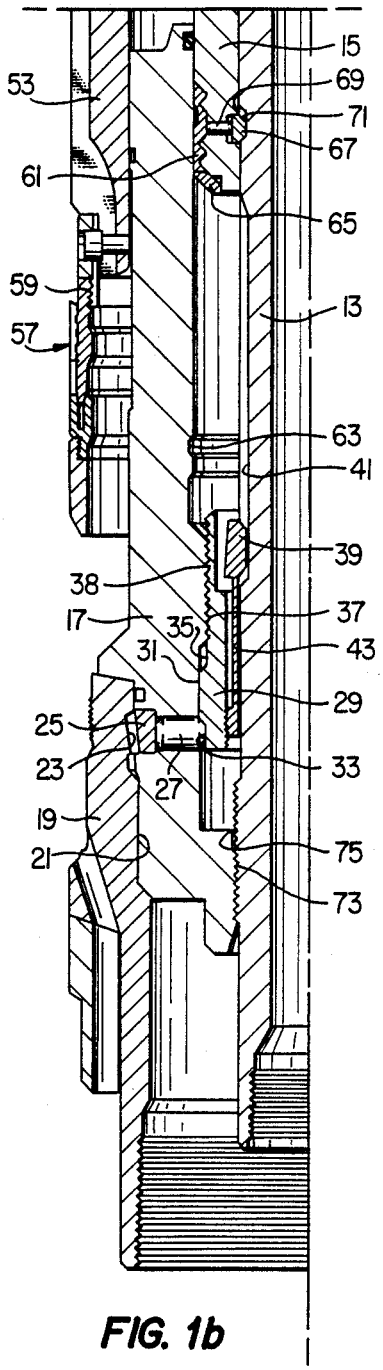

Lifting the mandrel 13 relative to the lower body 17 then pulls the upper body 15 back to the upper position shown in FIGS. 1*a* and 1*b*. The mandrel 13 is rotated to the right to cause its threads 75 to engage the threads 73, shown in FIG. 1*b*. This holds the upper body 15 in the upper position relative to lower body 17. The mandrel 13 will be rotated to the right until cam 29 moves all the way to the bottom, with the upper recess 35 engaging the link pins 27. Then the mandrel 11 will be rotated to the left again with the turns carefully counted, to make sure that the cam 29 moves to the position shown in FIG. 1*b*. In this position, the lower recess 33 will be engaging the link pins 27. The tool is now recocked.

The invention has significant advantages. The mechanism for connecting the running tool to the casing hanger allows the mandrel to move through the various setting positions without the cam passing into a released position until the packoff is fully set.

While the invention has been shown in only one of its forms, it should be apparent to those skilled in the art that it is not so limited, but is susceptible to various changes without departing from the scope of the invention.

We claim:

1. A tool for setting a packoff in an annular space between a casing hanger and a wellhead, the casing hanger having an inner wall containing a groove, the tool comprising in combination:

a mandrel having an upper end for connection to a string of drill pipe;

a body carried by the mandrel, the mandrel being axially movable relative to the body;

a setting sleeve carried by the mandrel for connection to the packoff;

an engaging element carried by the body, and movable between an inner retracted position and an outer engaged position in engagement with the groove in the casing hanger for securing the body to the casing hanger;

an annular cam secured by threads to the body, the cam having lobe means for urging the engaging element into the groove in the casing hanger when the cam is rotated relative to the body to move the cam axially to an engaging position, and for allowing the engaging element to retract when the cam is again rotated relative to the body to move the cam axially to a nonengaging position;

the mandrel extending through the cam and having a longitudinal slot on its exterior;

a dog adapted to enter the slot in the mandrel;

means connecting the dog to the cam for rotation therewith and for biasing the dog into contact with the mandrel so that the dog will enter the slot when the mandrel is positioned to align the slot with the dog, causing rotation of the mandrel to rotate the cam relative to the body for moving the cam longitudinally between the engaging and nonengaging positions;

setting means for setting the packoff in the annular space, the setting means being actuated by axial movement of the mandrel and the setting sleeve, the slot moving out of engagement with the dog during said axial movement; and after the packoff has been set, further axial movement of the mandrel in an opposite direction causing the slot to move adjacent the dog, whereby rotation of the mandrel causes the dog to reenter the slot and rotate the cam relative to the body to the nonengaging position to release the engaging element from the casing hanger.

2. A tool for setting a packoff in an annular space between a casing hanger and a wellhead, the casing hanger having an inner wall containing a groove, the tool comprising in combination:

a mandrel having an upper end for connection to a string of drill pipe;

a setting sleeve carried by the mandrel for connection to the packoff;

a body carried by the mandrel, the mandrel being axially movable relative to the body, the body having a set of interior threads;

an engaging element carried by the body, and movable between an inner retracted position and an outer engaged position in engagement with the groove in the casing hanger for securing the body to the casing hanger;

an annular cam having a set of exterior threads which are adapted to engage the interior threads formed in the body, the cam having an exterior lobe which urges the engaging element into the groove in the casing hanger when the cam is in an engaging position, the cam having a recess area next to the lobe which allows the engaging element to retract when the cam is in a nonengaging position;

the mandrel extending through the cam and having a longitudinal slot on its exterior;

a dog adapted to enter the slot in the mandrel;

means connecting the dog to the cam for rotation therewith and for biasing the dog into contact with the mandrel so that the dog will enter the slot when the mandrel is positioned to align the slot with the dog, causing rotation of the mandrel to rotate the cam relative to the body for moving the cam longitudinally between the engaging and nonengaging positions;

setting means for setting the packoff in the annular space, the setting means being actuated by downward movement of the mandrel and the setting sleeve, the slot moving below the dog during said downward movement; and upward movement of the mandrel after the packoff has been set causing the slot to move adjacent the dog, whereby rotation of the mandrel causes the dog to reenter the slot and rotate the cam relative to the body to the nonengaging position to release the engaging element from the casing hanger.

3. A tool for setting a packoff in an annular space between a casing hanger and a wellhead, the casing hanger having an inner wall containing a groove, the tool comprising in combination:

a mandrel having an upper end for connection to a string of drill pipe;

a setting sleeve carried by the mandrel for connection to the packoff;

a body carried by the mandrel, the mandrel being axially movable relative to the body, the body having a set of interior threads;

an engaging element carried by the body, and movable between an inner retracted position and an outer engaged position in engagement with the groove in the casing hanger for securing the body to the casing hanger;

an annular cam having a set of exterior threads which are adapted to engage the interior threads formed in the body, the cam having an exterior lobe which urges the engaging element into the groove in the casing hanger when the cam is in an engaging position, the cam having a recess area next to the lobe which allows the engaging element to retract when the cam is in a nonengaging position longitudinally spaced from the engaging position;

the mandrel extending through the cam and having a longitudinal slot on its exterior;

a dog adapted to enter the slot in the mandrel;

a linking member having one end connected to the cam for rotation therewith and another end joined to the dog, the linking member being resilient for urging the dog into contact with the mandrel so that the dog will enter the slot when the mandrel is positioned to align the slot with the dog, the dog causing rotation of the mandrel to rotate the cam relative to the body for moving the cam between the engaging and nonengaging positions;

setting means for setting the packoff in the annular space, the setting means being actuated by downward movement of the mandrel and the setting sleeve, the slot moving below the dog during said downward movement; and upward movement of the mandrel after the packoff has been set causing the slot to move adjacent the dog, whereby rotation of the mandrel causes the dog to reenter the slot and rotate the cam relative to the body to the nonengaging position to release the engaging element from the casing hanger.

4. A tool for setting a packoff in an annular space between a casing hanger and a wellhead, the casing hanger having an inner wall containing a groove, the tool comprising in combination:

a mandrel having an upper end for connection to a string of drill pipe;

a body carried by the mandrel, the mandrel being axially movable relative to the body, the body having a setting sleeve chamber, the mandrel and the body having a mandrel chamber located between them;

a setting sleeve carried by the body for connection to the packoff;

an engaging element carried by the body, and movable between an inner retracted position and an outer engaged position in engagement with the groove in the casing hanger for securing the body to the casing hanger;

an annular cam secured by threads to the body inward of the engaging element, the cam having lobe means for urging the engaging element into the groove in the casing hanger when the cam is rotated relative to the body to move the cam to an engaging position, and for allowing the engaging element to retract when the cam is subsequently rotated relative to the body to move the cam to a non-engaging position;

the mandrel extending through the cam;

a setting sleeve piston carried by the body in the setting sleeve chamber for movement relative to the body and positioned to contact an upper end of the setting sleeve;

a mandrel piston carried by the mandrel for movement therewith within the mandrel chamber, the mandrel piston having a smaller pressure area than the setting sleeve piston;

passage means located in the body sealed from the exterior of the body for communicating the mandrel chamber with the setting sleeve chamber, the setting sleeve chamber above the setting sleeve piston and the mandrel chamber below the mandrel piston containing a hydraulic fluid, so that axial movement of the mandrel piston and mandrel relative to the body due to movement of the drill string increases the pressure of the hydraulic fluid to exert a downward force on the setting sleeve piston to move the setting sleeve downward to set the packoff; and rotational linking means on the cam and the mandrel for causing rotation of the mandrel to rotate the cam relative to the body to move the cam between the engaging and nonengaging positions, and for allowing the mandrel to move axially relative to the cam for actuating the setting sleeve.

* * * * *